US006506715B1

(12) United States Patent
Schultz et al.

(10) Patent No.: US 6,506,715 B1
(45) Date of Patent: Jan. 14, 2003

(54) AUTOMOTIVE WASH AND WAX COMPOSITION AND METHOD OF USE THEREOF

(75) Inventors: Michael A. Schultz, Lockport, IL (US); Denis John Healy, Chicago, IL (US)

(73) Assignee: Turtle Wax, Inc., Chicago, IL (US)

( * ) Notice: Subject to any disclaimer, the term of this patent is extended or adjusted under 35 U.S.C. 154(b) by 0 days.

(21) Appl. No.: 10/043,429

(22) Filed: Jan. 10, 2002

(51) Int. Cl.[7] ..... C11D 9/36

(52) U.S. Cl. ..... 510/189; 510/208; 510/243; 510/245; 510/254; 510/466; 510/504; 510/427; 106/2; 106/3; 106/14.31; 106/18.12; 106/660; 106/806

(58) Field of Search ..... 510/189, 208, 510/243, 245, 254, 466, 504, 427; 106/2, 3, 14.31, 18.12, 660, 806

(56) References Cited

U.S. PATENT DOCUMENTS 3,222,201 A 12/1965 Boyle et al.
3,329,637 A 7/1967 Vitalis
4,398,953 A * 8/1983 Van Der Linde ..... 106/10
4,600,436 A * 7/1986 Traver et al. ..... 106/3
4,665,116 A 5/1987 Kornhaber
5,043,012 A * 8/1991 Shinohara ..... 106/10
5,073,407 A 12/1991 Fraser
5,294,248 A * 3/1994 Chittofrati et al. ..... 106/10
6,201,058 B1 * 3/2001 Mahr et al. ..... 524/506
6,207,596 B1 3/2001 Rourke et al.

OTHER PUBLICATIONS

Rachel C. Heald "Useful Combinations of Anionic and Cationic Surfactants" American Perfumer & Aromatics, vol. 75, Apr. 1960, pp. 45–47.

* cited by examiner

*Primary Examiner*—Charles Boyer
(74) *Attorney, Agent, or Firm*—Olson & Hierl, Ltd.

(57) ABSTRACT

An automobile wash and wax composition suitable for simultaneously washing and waxing a soiled exterior surface of a vehicle without buffing. The automotive wash and wax composition being an aqueous emulsion containing an anionic surfactant, a silicone oil, an amino-functional silicone, a wax, and a cationic emulsifier. The wash and wax composition is applied to a pre-wetted exterior surface of a vehicle so as to substantially coat the surface of the vehicle that requires cleaning and polishing. After the coated surface has substantially dried, the surface is washed with a sufficient quantity of water to rinse away the soil particles and the residue of the anionic surfactant, leaving behind a durable, evenly distributed, high-gloss, water resistant protective film of silicones and wax on the vehicle surface, without any buffing of the surface.

30 Claims, No Drawings

AUTOMOTIVE WASH AND WAX COMPOSITION AND METHOD OF USE THEREOF

FIELD OF THE INVENTION

This invention relates to a composition and method for simultaneously washing and waxing an automotive exterior surface. More particularly, this invention relates to a wash and wax composition comprising a an anionic surfactant, a silicone oil, an amino-functional silicone, a wax, and a cationic emulsifier. The invention also relates to a method of cleaning and polishing an automotive exterior surface utilizing the wash and wax composition.

BACKGROUND OF THE INVENTION

A number of products are available for washing and waxing cars. Leading brand car washing compositions are typically based on blends of anionic surfactants. Anionic surfactants provide excellent foam, good foam stability, and soft lubricious foam. In addition, anionic surfactants provide excellent soil removal and good wetting to automotive exterior surfaces and are easily and uniformly rinsed from the surface with water.

Car wax compositions based on cationic wax or silicone emulsions are known to impart finishes with high gloss, shine, water resistance (beading) and durability. Cationic emulsifiers/surfactants in car wax or sealer waxes provide additional ionic bonding strength to an automotive finish, which holds the wax or silicone-based sealants to the surface better than hydrogen bonding or simple van der Waals forces.

Most car wash formulations require a two step application process. The first stem is applying the wax formulation to the vehicle surface and allowing the wax to dry. The second step involves wiping away excess wax composition and in many cases vigorously buffing the vehicle surface to obtain a uniform, glossy finish.

It is well known that anionic surfactants and cationic surfactants have limited compatibility with each other. Cationic surfactants and anionic surfactants often form insoluble salts with each other, thus causing difficulty in formulating mixed products. For this reason, among others, anionic-based wash compositions and cationic wax compositions are provided as separate products to be applied in separate operations.

There is a need, therefore, for an automotive wash and wax composition that combines the superior cleaning power of an anionic car wash with the superior durability, water resistance and high gloss of a cationic wax composition. In addition, there is a need for automotive wax compositions which impart high gloss, shine, water resistence and durability without the need for buffing of the vehicle surface.

SUMMARY OF THE INVENTION

An automotive wash and wax composition, suitable for simultaneously washing and polishing an automobile exterior surface is a concentrated aqueous silicone-based wax emulsion comprising an anionic surfactant, a silicone oil, such as polydimethylsiloxane, an amino-functional silicone, such as an aminoethylaminopropylsiloxane—dimethylsiloxane copolymer, a wax, such as carnauba wax, and a cationic emulsifier. The automotive wash and wax composition can optionally contain additional components such as UV absorbers, solvents, fragrances, colorants, preservatives, thickening agents, neutralizing agents and stabilizing agents.

The anionic surfactant functions to clean the automotive surface of soil such as dirt and grease. The silicone oil and wax components provide a high-gloss, durable shine to the automotive exterior surface. The amino-functional silicone component of the composition provides strength and durability to the resulting wax and silicone oil film after application to the vehicle surface, while the cationic emulsifier aids in binding the wax and silicone film to the automotive exterior surface.

The automotive wash and wax composition is applied to a prewetted automobile exterior surface with a cloth, sponge or mitt. The composition can be diluted with water prior to application, if desired. After the automotive surface has been coated with the wash and wax composition, the coated surface is dried until a translucent film is formed thereon. After the waxed surface is substantially dry, the waxed surface is rinsed with water. this water rinse substantially removes the anionic surfactant and any soil particles from the surface, as well as the formed translucent film, and leaves behind a wax and silicone-based protective film on the automotive surface. After rinsing, the automotive surface can be towel dried. A uniform, durable, high-gloss protective film is thus obtained, without the need for buffing or additional wiping away of excess polish as is generally required with conventional car wax applications.

DETAILED DESCRIPTION OF PREFERRED EMBODIMENTS

An automotive wash and wax composition, suitable for simultaneously washing and polishing an automobile exterior surface comprises a an aqueous emulsion containing an anionic surfactant, a silicone oil, an amino-functional silicone, a wax, and a cationic emulsifier.

As used herein, the term "silicone" and grammatical variations thereof means a polymer having the general formula $(R_nSiO_{((4-n)/2)})_m$ wherein n is between 0 and 3 and m is 2 or greater, and R is alkyl or aryl, as defined in *Silicone Compounds Register and Review*, 5th Edition, R. Anderson, G. L. Larson and C. Smith Eds., Hüls America Inc., Piscataway, N.J., p 247 (1991). Silicones can be linear or branched. The term "amino-functional silicone" and grammatical variations thereof means a silicone as defined above, wherein the alkyl or aryl group is substituted with a primary, secondary or tertiary amino group. The term "silicone-based" as used herein means a material that contains a silicone component.

When referred to herein, the viscosity of a liquid component of the invention is quoted as a kinematic viscosity in centistokes (cSt), measured at 25° C. (77° F.), unless otherwise specified.

In the compositions of the present invention, preferably the anionic surfactant component is present in excess of the cationic emulsifier/surfactant. Optionally, a nonionic surfactant can be can be added to the automotive wash and wax composition of the present invention to aid in solubilizing the anionic/cationic surfactant salts or to enhance the detergency of the formulation.

Anionic, cationic, non-ionic and amphoteric surfactants and emulsifiers useful in the automotive wash and wax composition of the present invention include surfactants and emulsifiers such as described in the review on surfactants by Cahn and Lynn, "Surfactants and Detersive Systems" *Kirk-Othmer Encyclopedia of Chemical Technology*, 3 rd Edition, Volume 22, John Wiley & Sons, New York, pp. 332–432

(1983), the relevant disclosures of which are incorporated herein by reference. An extensive listing of anionic, cationic, nonionic and amphoteric surfactants ,and commercial sources thereof, can be found in *McCutcheon's, Volume* 1. *Emulsifiers & Detergents, North American Edition*, McCutcheon's Division, The Manufacturing Confectioner Publishing Co., Rock Glen, N.J. (2001), the relevant disclosures of which are incorporated herein by reference.

Preferably, the automotive wash and wax composition of the present invention contains about 5 to about 40 weight percent of an anionic surfactant, more preferably about 8 to about 30 weight percent.

Preferred anionic surfactants include an alkylcarboxylate (soap), a polyalkoxycarboxylate, an N-acylsarcosinate, a linear alkylbenzenesulfonate (LAS), an alpha-olefin sulfonate (AOS), a dialkylsulfosuccinate, an alcohol sulfate, and an ethoxylated alcohol sulfate. Combinations of two or more of the aforementioned anionic surfactants are also useful the compositions of the present invention.

Typical alkylcarboxylates (soaps) include sodium, potassium or ammonium salts of $C_9$–$C_{21}$, fatty or rosin acids such as lauric acid, palmitic acid, stearic acid, coconut fatty acids, hydrogenated coconut fatty acids, oleic acid, and the like.

Typical polyalkoxycarboxylates include alkoxylated alcohols which have been end-capped with chloroacetate or acrylic acid. Polyalkoxycarboxylates are produced by reaction of ethylene oxide, propylene oxide, or mixtures thereof, with an alcohol, to produce an alkoxylated alcohol having about 2 to about 50 moles of oxyalkylene groups per mole of alcohol, followed by reaction of the free hydroxyl end group of the alkoxylate with chloroacetate or acrylate.

Typical N-acylsarcosinates are amidocarboxylates produced by the reaction of a fatty acid or rosin acid chloride with sodium sarcosinate. Commercial examples include sodium N-cocoylsarcosinate, sodium N-laurylsarcosinate, sodium N-oleoylsarcosinate and the like.

Typical commercial linear alkylbenzenesulfonates (LAS) include alkali metal or ammonium salts of alkylbenzenesulfonic acids, wherein the alkyl substituent is a linear $C_9$–$C_{13}$ alkyl group such as sodium dodecylbenzene sulfonate (SDS).

Typical alpha-olefin sulfonates (AOS) are the products of sulfonation of alpha-olefins with sulfur trioxide and air, followed by neutralization of the intermediate sultones. Typical commercial examples include sulfonated $C_{10}$ to $C_{14}$ alpha-olefin, generally neutralized with an alkali metal hydroxide, an alkaline earth hydroxide, or an ammonium hydroxide.

Typical dialkylsulfosuccinates are alkali metal or ammonium salts of $C_5$–$C_{18}$ diesters of sulfosuccinic acid, such as sodium diamylsulfosuccinate, sodium dioctylsulfosuccinate, sodium di-(2-ethylhexyl)sulfosuccinate and the like.

Typical commercial alcohol sulfates include alkali metal, alkaline earth metal or ammonium salts of sulfate esters of $C_8$–$C_{12}$ alcohols such as sodium laurylsulfate, sodium 2-ethylhexylsulfate, lauryl triethanolammonium sulfate, sodium octylsulfate and the like.

Typical ethoxylated alcohol sulfates are alkali metal or ammonium salts of sulfate esters of $C_8$–$C_{18}$ alcohols ethoxylated with about 10 to about 40 weight percent of ethylene oxide, based on the weight of alcohol.

Preferably, the cationic emulsifier comprises about 0.2 to about 0.9 weight percent of the composition, more preferably about 0.3 to about 0.7 weight percent.

Preferred cationic emulsifiers include an amine, an aliphatic or rosin amine ethoxylate, an amidoamine, and a quaternary ammonium salt. Amphoteric emulsifiers that exhibit cationic properties below a pH of about 7 are also suitable for the present purposes and are included herein under the term "cationic emulsifier." Illustrative of such amphoteric emulsifiers are cocamidopropyl betaine, carboxyalkyl imidazolines, and the like. Combinations of two or more of the aforementioned cationic emulsifiers can also be utilized in the compositions of the present invention.

Typical amine cationic emulsifiers include amines derived from fatty acids and rosins such as hydrogenated tallow amine, stearyl amine, lauryl amine, and the like, which are typically commercially available as acetate, oleate or naphthalenate salts. Other useful amine cationic emulsifiers include N-alkyltrimethyleneamines having the general formula $R^*NHCH_2CH_2CH_2NH_2$, wherein $R^*$ is an alkyl group derived from natural oils such as coconut, tallow and soybean oils and the like; 2-alkylimidazolines, such as 2-heptadecylimidazoline, 2-heptadecenylimidazoline and the like; and 1-aminoethyl-2-alkyl imidazolines.

Typical commercially available aliphatic and rosin amine ethoxylate cationic emulsifiers include $C_6$–$C_{20}$ alkyl amines and rosin amines that have been ethoxylated with about 2 to about 50 moles of ethylene oxide per mole of amine, such as cocoamine, soyamine or stearylamine ethoxylated with 2 to 15 moles of ethylene oxide per mole of amine.

Typical amidoamine cationic emulsifiers include condensation products of fatty carboxylic acids with di- and polyamines, such as condensates of diethylenetriamine with stearic, oleic, coconut, or tall oil fatty acids, and the like.

Typical quaternary amine cationic emulsifiers include dialkyldimethylammonium salts, such as dicocodimethylammonium chloride, distearyldimethylammonium chloride, and the like; alkylbenzyldimethylammonium chlorides such as cocobenzyldimethylammonium chloride, tallowbenzyldimethylammonium chloride, stearylbenzyldimethylammonium chloride and the like; and alkyltrimethylammonium salts such as cetyltrimethylammonium chloride, myristyltrimethylammonium bromide and the like; wherein the above alkyl groups are derived from fatty amines and rosin amines.

Particularly preferred cationic emulsifiers include fatty amines and rosin amines such as hydrogenated tallow amine, rosin amine ethoxylates, such as N,N-bis(2-hydroxyethyl)cocamine, N,N-bis(2-hydroxyethyl) soyamine; and salts thereof. Preferred salts are the acetates.

The automotive wash and wax compositions of the present invention can optionally contain nonionic surfactants in amounts up to about 25 weight percent, preferably about 10 to about 20 weight percent.

Preferred nonionic surfactants useful in the automotive wash and wax composition of the present invention include an alcohol alkoxylate, a polyol ester of a fatty acid, a polyoxyethylene ester of a fatty acid, a fatty acid amide, a polyoxyethylene fatty acid amide, a polyalkylene oxide block copolymer, an ethoxylated alkyl mercaptan, an ethoxylated anhydrosorbitol ester, and an alkyl polyglycoside. Also suitable are amine oxides prepared by hydrogen peroxide oxidation of tertiary aliphatic amines such as cetyldimethylamine oxide, stearyldimethylamine oxide, tallow-bis-(2-hydroxyethyl)amine oxide, stearyl-bis(2-hydroxyethyl)amine oxide, and the like. Combinations of two or more of the aforementioned nonionic surfactants are also useful in the compositions of the present invention.

Typical alcohol alkoxylates include ethoxylated $C_6$–$C_{18}$ linear and branched alcohols, ethoxylated with about 2 to about 80 moles of ethylene oxide, such as ethoxylated lauryl alcohol, ethoxylated stearyl alcohol, and ethoxylated mixtures of $C_6$–$C_{18}$ alcohols, and alkoxylated natural alcohols such as ethoxylated propoxylated pine oil, ethoxylated soya sterol, and the like.

Typical polyol esters of fatty acids include saturated fatty acid monoglycerides, such as glycerol monolaurate, glycerol monococo ester, glycerol monotallow ester, glycerol monostearate, and the like; saturated fatty acid diglycerides, such as glycerol distearate, glycerol dilaurate and the like; unsaturated fatty acid monoglycerides, such as glycerol monooleate, glycerol monoricinoleate, and the like; unsaturated fatty acid diglycerides, such as glycerol dioleate, glycerol dilinoleate, and the like; glycol esters of fatty acids, such as propylene glycol monostearate, ethylene glycol monostearate, ethylene glycol monolaurate, diethylene glycol monooleate, diethylene glycol monostearate, and the like; and anhydrosorbitol fatty acid esters, such as mono, di and tri esters of 1,4-sorbitan with fatty acids such as stearic acid, palmitic acid and oleic acid.

Typical polyoxyethylene esters of fatty acids are polyethylene glycol mono- and di-esters of fatty acids comprising a polyethylene glycol portion having from about 5 to about 30 ethyleneoxy units, esterified at one or both ends with fatty acids such as stearic acid, lauric acid, oleic acid, and mixed fatty acids derived from natural oils such as coconut oil, castor oil, tall oil, and the like.

Typical fatty acid amides include diethanolamine fatty acid condensates such as coco diethanolamide, lauric diethanolamide, tall oil diethanolamide, and the like, and monoalkanolamine fatty acid condensates such as coco monoethanolamide, lauric monoethanolamide, stearic monoisopropanolamide, oleic monopropanolamide, and the like.

Typical polyoxyethylene fatty acid amides are ethoxylated mono and dialkanolamides having from about 2 to about 50 ethylene oxide groups, including ethoxylated lauric monoisopropanolamide, ethoxylated stearic diethanolamide, ethoxylated myristic monoethanolamide, ethoxylated oleic diethanolamide, and the like.

Typical polyalkylene oxide block copolymers include copolymers of ethylene oxide and propylene oxide initiated by ethylene glycol, propylene glycol, trimethylol propane, and the like, and have either linear or branched structures, depending on whether the initiator has two or three hydroxyl groups, respectively.

Typical ethoxylated alkyl mercaptans, include linear or branched alkyl mercapatans such as dodecylmercaptan, ethoxylated with 2 to 10 moles of ethylene oxide per mole of mercaptan.

Typical ethoxylated anhydrosorbitol esters are mono, di and tri esters of 1,4-sorbitan with fatty acids such as stearic acid, palmitic acid and oleic acid that have been ethoxylated with about 4 to about 20 moles of ethylene oxide per mole of anhydrosorbitol ester.

Typical alkyl polyglycosides are glycosides (acetals) of $C_6$–$C_{20}$ alcohols with a monosaccharide such as glucose, fructose, lactose, mannose, xylose and the like or a polysaccharide or oligosaccharide such as isomaltose, maltose, cellobiose, mellobiose, maltotriose and the like.

Particularly preferred nonionic emulsifiers include fatty acid alkanolamides such as coconut diethanolamide, soya diethanolamide, and the like, and mixtures thereof.

Preferably, the present composition contains about 1 to about 5 weight percent of a silicone oil, more preferably about 1 to about 3 weight percent.

Preferred silicone oils are $C_1$–$C_{18}$ alkyl or $C_6$–$C_{10}$ aryl substituted polysiloxanes, more preferably poly($C_1$–$C_4$ dialkyl)siloxanes. Most preferably, the silicone oil is a polydimethylsiloxane. The silicone oils useful in the car wax emulsions of the present invention preferably are selected from silicones having a viscosity in the range of about 10 centistokes (cSt) to about 60,000 cSt, more preferably about 20 cSt to about 5000 cSt, and most preferably about 350 cSt to about 1000 cSt. The silicone oils can comprise a blend of several different viscosity silicones. In such blends it is preferred that the viscosity of the blend is in the range of about 10 cSt to about 60,000 cSt, more preferably about 20 cSt to about 5000 cSt, and most preferably about 20 cSt to about 1000 cSt. Useful silicone oils are commercially available from a variety of manufacturers such as GE Silicones of Waterford, N.Y. and Dow Corning Corporation of Midland, Mich.

Preferably, the amino-functional silicone constitutes about 0.1 to about 1 weight percent of the automotive wash and wax composition of the present invention, more preferably about 0.5 to about 0.8 weight percent.

Amino-functional silicones useful in the present invention include silicone polymers that contain primary, secondary or tertiary amino functional groups. Preferably the amino-functional silicones are copolymers of dialkylsiloxane and amino-functional siloxane comonomers. Preferably the amino-functional silicones contain about 1 to about 50 mole percent of aminofunctional siloxane comonomer units, more preferably about 1 to about 30 mole percent of amino-functional siloxane comonomer units. These silicone fluids can contain starting materials and reaction by-products in addition to the amino-functional dialkylpolysiloxane. Suitable amino-functional silicones include those disclosed in co-owned U.S. Pat. No. 4,665,116 to Kornhaber et al., the pertinent disclosures of which are incorporated herein by reference.

A useful amino-functional dialkylpolysiloxane, for example, can be derived from the equilibration of a polydialkylsiloxane having a viscosity of about 1 to about 30,000 cSt with an amino-functional silane or siloxane in the presence of a basic catalyst. Typical polydialkylsiloxanes useful for the preparation of amino-functional silicones include cyclic dimethysiloxane oligomers having about 3 to about 10 dimethylsiloxane monomer units.

The amino-functional silanes or siloxanes, which are reacted with the dialkylpolysiloxanes can be represented by the general formula (I):

$$[QSi(G_a)O_{((3-a)/2)}]_xZ_b \quad \text{(I)}$$

wherein G represents the radicals R, OR", $NR'_2$, or $OSiR_3$ in which R is $C_1$–$C_{18}$ alkyl or $C_6$–$C_{10}$ aryl, R' represents hydrogen or monovalent hydrocarbon radicals having 1 to about 18 carbon atoms, R" is a substituted or unsubstituted divalent $C_1$–$C_{18}$ hydrocarbon radical, a substituted or unsubstituted divalent oxyalkylene group in which the oxygen provides an ether linkage, or an unsaturated divalent $C_4$–$C_{18}$ hydrocarbon radical; Q represents the radicals:

$$R'_2N—R"—,\ R'_2N—R"—N(R')—R"— \text{ and } R'_2N—R"—O—R"—$$

Z is a radical selected from the group consisting of $R_3SiO_{0.5}$, and $R'_2NR"_{0.5}$ in which R, R' and R" are the same as above, a is a number having a value of about 0 to about 2; b is a number having a value of about 0 to about 3; and x is a number having a value of about 1 to 20,000. Preferably, R' is hydrogen.

Illustrative divalent radicals represented by R" are hydrocarbon radicals having from 2 to 18 carbon atoms such as ethylene, trimethylene, tetramethylene, hexamethylene, octamethylene; oxyalkylene group radicals having the formulas: $(—OC_2H_4—)_r$, $(—OC_2H_4OCH_2—)_r$ and $(—OC_3H_6—)_r$ in which r is a number having a value of about 1 to about 50, such as ethylene oxide, trimethylene oxide and polymers thereof and alkylene radicals such as vinylene, propenylene, butenylene, hexenylene and the like.

Examples of suitable amino-functional silanes include but are not limited to 2-aminoethyltriethoxysilane, 3-aminopropyltrimethoxysilane, (3-(2-aminoethylamino) propyl)methyldimethoxysilane, 6-aminohexyltributoxysilane, 6-(2-aminoethoxy) hexyltriethoxysilane, 4(3-aminopropoxy) butyltributoxysilane, and the like.

Useful amino-functional dialkylpolysiloxanes and methods for preparing them are described in U.S. Pat. Nos. 3,890,269, 3,960,575 and 4,247,330 the pertinent disclosures of which are incorporated herein by reference.

Preferred amino-functional silicones are polymers comprising repeating units represented by the general formula (II):

$$[—Si(R_{(2-p)})(Q_p)O—]_q[—Si(CH_3)_2O—]_y \quad (II)$$

wherein Q represents the radicals:

$$R'_2N—R"—,\ R'_2N—R"—N(R')—R"— \text{ and } R'_2N—R"—O—R"—$$

R is $C_1$–$C_{18}$ alkyl or $C_6$–$C_{10}$ aryl; R' represents hydrogen or monovalent hydrocarbon radicals having 1 to about 18 carbon atoms; R" is a substituted or unsubstituted divalent $C_1$–$C_{18}$ hydrocarbon radical, a substituted or unsubstituted divalent oxyalkylene group in which the oxygen provides an ether linkage, or an unsaturated divalent $C_4$–$C_{18}$ hydrocarbon radical; p is number having a value in the range of about 1 to about 2; q is a number having value in the range of about 1 to about 2000; and y is a number having value in the range of about 0 to about 2000; with the proviso that the sum of q and y is at least about 15.

Examples of suitable amino-functional silicones include (2-aminoethyl)methylpolysiloxane, (3-aminopropyl)methylpolysiloxane, (2-aminoethyl-3-aminopropyl)methylpolysiloxane, (3-(2-aminoethyoxy)propyl)methylpolysiloxane, (6-aminohexyl)methylpolysiloxane, (3-(2-aminoethoxy)propyl)methylpolysiloxane, (3-(2-aminoethylamino)propyl)methylsiloxane, dimethylsiloxane copolymers thereof, and the like.

A particularly preferred amino-functional polydimethylsiloxane is commercially available under the designation SF-1706 from GE Silicones, Waterford, N.Y., and is a copolymer of aminoethyaminopropylsiloxane and dimethylosiloxane according to the manufacturer's product literature.

Other suitable amino-functional silicones are available from GE Silicones, of Waterford, N.Y., Dow Corning Corporation of Midland, Mich. and OSi Specialties, Inc. of Danbury, Conn.

The present composition preferably contains about 0.01 to about 1 weight percent of a wax, more preferably about 0.05 to about 0.8 weight percent.

Waxes suitable for use in the automotive wash and wax compositions of the present invention include vegetable waxes such as carnauba, candelilla, and ouricury; mineral waxes such as montan, paraffin, and microcrystalline waxes; animal waxes, such as, beeswax; and synthetic waxes such as amide waxes and silicone waxes. Combinations of two or more of the aforementioned waxes can also be utilized in the compositions of the present invention.

Optional components that can be included in the automotive wash and wax compositions include UV absorbers such as benzotriazoles, benzophenones, and the like; polymeric UV absorbers having a UV chromophore attached to a polymer backbone, solvents such as mineral oil and butyl cellosolve, fragrances, colorants, preservatives, thickening agents, abrasive polishing agents such as silicas, zeolites, and the like, and neutralizing/stabilizing agents such as mineral acids or organic acids. The optional components can comprise up to about 15 weight percent of the aqueous silicone-based car wax emulsion, usually about 1 weight percent.

Preferably, the automotive wash and wax composition of the present invention contains silicone oil and amino-functional silicone in a weight ratio of about 1:1 to about 5:1, more preferably about 2:1 to about 3:1.

Preferably the cationic emulsifier is present in the composition in a ratio of total silicone-to-cationic emulsifier of about 2:1 to about 5:1, more preferably about 3:1 to about 4:1, wherein "total silicone" represents the sum of silicone oil content and amino-functional silicone content of the composition.

The anionic emulsifier is preferably present in the automotive wash and wax composition in a ratio of anionic surfactant-to-cationic emulsifier of about 5:1 to about 150:1, more preferably about 10:1 to about 60:1.

The weight ratio of silicone oil-to-wax in the automotive wash and wax compositions is preferably about 5:1 to about 50:1, more preferably about 10:1 to about 30:1, most preferably about 15:1 to about 20:1.

The automotive wash and wax compositions of the present invention can be manufactured as an aqueous emulsion by mixing an anionic surfactant, silicone oil, amino-functional silicone, wax, cationic emulsifier, and optional ingredients such as preservative, solvent, thickening agent, neutralizing agent, fragrance, colorant, and stabilizer, to form an emulsion. Preferably, the silicone oil and amino-functional silicone and optional solvent, stabilizer and preservative are mixed with a portion of the water and emulsified with a portion of the cationic emulsifier to form an intermediate aqueous silicone emulsion. Preferably an intermediate wax emulsion is separately prepared by mixing the wax, a portion of the water and a portion of the cationic emulsifier. The automotive wash and wax composition is then prepared by mixing the silicone emulsion, the wax emulsion, anionic surfactant, optional additional components in the remainder of the water until a stable, homogeneous emulsion is formed.

A preferred formulation of an automotive wash and wax composition according to the present invention is an aqueous emulsion containing about 5 to about 40 weight percent anionic surfactant; about 1 to about 10 weight percent of a silicone oil; about 0.1 to about 1 weight percent of an amino-functional silicone; about 0.01 to about 1 weight percent of a wax; and about 0.2 to about 0.9 weight percent of a cationic emulsifier.

A particularly preferred formulation of an automotive wash and wax composition of the present invention is an aqueous emulsion containing about 8 to about 30 weight percent anionic surfactant; about 1 to about 6 weight percent of a silicone oil; about 0.5 to about 0.8 weight percent of an amino-functional silicone; about 0.05 to about 0.8 weight percent of a wax; about 0.3 to about 0.7 weight percent of a cationic emulsifier; and up to about 20 weight percent of additional additives such as non-ionic surfactant, preservative, neutralizing agent, stabilizer, thickener, solvent, colorant , abrasive polishing agents, and fragrance.

The automotive wash and wax composition is applied to a pre-wetted automobile exterior surface with a pre-wetted cloth, sponge, or mitt. The composition can be diluted with water prior to application, if desired.

The composition is rubbed onto the wet automobile exterior surface, preferably in a circular motion. After the automotive surface has been coated with the wash and wax composition, the coated surface is dried until a translucent film is formed thereon. When the surface is substantially dry, it is rinsed with a sufficient quantity of water to remove formed film and substantially all of the anionic surfactant residue and any soil particles present from the surface. The automotive surface can be towel dried after rinsing. A uniform, durable, high-gloss, water resistant, protective film is thus obtained, without the need for buffing or additional wiping away of excess polish as is generally required with conventional car wax products.

EXAMPLE 1

Automotive Wash and Wax Composition A

An automotive wash and wax composition of the present invention was prepared containing the following components: about 83 weight percent water, about 12 weight percent of anionic surfactant, about 1.6 weight percent silicone oil, about 0.71 weight percent amino-functional silicone, about 0.1 weight percent wax, about 0.6 weight percent of cationic emulsifier, about 0.3 weight percent preservative, about 1.5 weight percent of solvent, about 0.25 weight percent thickener, and about 0.08 weight percent of a neutralizing agent.

A cationic silicone emulsion was prepared by mixing about 20 weight percent silicone oil, about 8.85 weight percent amino-functional silicone, and about 6.5 weight percent cationic emulsifier (a 3:1 mixture of a quaternary amine and an ethoxylated tertiary fatty amine) in water containing about 18.5 weight percent solvent (11:1 mixture by weight of mineral oil-to-butyl cellosolve). A small amount of glacial acetic acid was added as a stabilizer and neutralizing agent (glacial acetic acid). About 0.1 weight percent of a preservative was also added.

A cationic wax emulsion was prepared by mixing about 10 weight percent carnauba wax and about 3.8 weight percent cationic emulsifier (tallow amine acetate) in water.

The Automotive Wash and Wax Composition A was then prepared by mixing about 12 weight percent anionic surfactant (1:1 blend of AOS and LAS), about 8 weight percent of the cationic silicone emulsion, about 1 weight percent of the cationic wax emulsion, about 0.25 weight percent thickener (hydroxypropyl methylcellulose) and about 0.3 weight percent preservative in water.

EXAMPLE 2

Automotive Wash and Wax Composition B

An automotive wash and wax composition of the present invention was prepared containing the following components: about 71 weight percent water, about 7 weight percent of anionic surfactant, about 6 weight percent silicone oil, about 0.5 weight percent amino-functional silicone, about 0.7 weight percent wax, about 0.5 weight percent of cationic emulsifier, about 0.17 weight percent preservative, about 1.4 weight percent of solvent, and about 0.08 weight percent of a neutralizing agent.

A cationic silicone emulsion was prepared by mixing about 20 weight percent silicone oil (350 cSt and 1000 cSt, 1:1), about 8.85 weight percent amino-functional silicone, and about 6.5 weight percent cationic emulsifier (a 3:1 mixture of a quaternary amine and an ethoxylated tertiary fatty amine) in water containing about 18.5 weight percent solvent (11:1 mixture by weight of mineral oil-to-butyl cellosolve). A small amount of glacial acetic acid was added as a stabilizer and neutralizing agent. About 0.1 weight percent of a preservative was also added.

A cationic wax emulsion was prepared by mixing about 10 weight percent carnauba wax and about 3.8 weight percent cationic emulsifier (tallow amine acetate) in water.

A nonionic wax emulsion was prepared by mixing about 1.7% carnauba wax, about 0.5 weight percent beeswax, about 7.8 weight percent montan wax, about 1 percent of nonionic surfactant (polyethylene glycol dioleate), and about 0.6 percent preservative in water.

A nonionic silicone emulsion was prepared by mixing about 50 weight percent silicone oil (350 cSt) about 4.3 weight percent of nonionic surfactant (a 1:5 mixture of sorbitan monolaurate and sorbitan ethoxylated (20) monooleate), and about 0.1 weight percent preservative in water.

The Automotive Wash and Wax Composition B was then prepared by mixing about 7 weight percent anionic surfactant (1:1 blend of AOS and LAS), about 7.5 weight percent of the cationic silicone emulsion, about 0.08 weight percent of the cationic wax emulsion, about 9 weight percent of the nonionic silicone emulsion, about 7 weight percent of the nonionic wax emulsion, about 11 percent nonionic surfactant (diethanolamine condensate of coconut oil fatty acid i.e, cocamide DEA), and about 0.15 weight percent preservative in water.

The following components were utilized in Automotive Wash and Wax Compositions A and B:

The amino-functional silicone was a copolymer having aminoethylaminopropylsiloxane and dimethylsiloxane repeating units, having a viscosity of about 10 to about 50 cSt and an amine content of about 0.48 milliequivalents of base per gram of polymer, SF-1706, available from GE Silicones of Waterford, N.Y.

The preservatives utilized in the examples included dimethyloldimethylhydantoin, which is commercially available under the designation Dantogard® from Lonza, Inc., Fairlawn, N.J.; 1,2-dibromo-2,4-dicyanobutane, which is commercially available under the designation Tektamer® 38 AD from Calgon Corp., Pittsburgh, Pa.; and poly (oxyethylene(dimethyiminio)ethylene dichloride) which is commercially available under the designation Busan® 77 from Buckman Laboratories, Inc., Memphis, Tenn., 2-((hydroxymethyl)amino)ethanol, which is commercially available under the designation Troysan® 174 from Troy Chemical Corp., Newark, N.J., and sodium benzoate.

The Automotive Wash and Wax Compositions of the Examples 1 and 2 were each utilized for cleaning soiled automobile exterior surfaces by the following procedure. About 3.5 fluid ounces of the composition was applied to a soiled automobile that were rinsed with water to wet the surface and remove loose dirt. The composition was applied to the vehicle exterior surfaces by rubbing the composition onto the automobile exterior surfaces using a circular rubbing motion. After the entire exterior of the vehicle was coated with the wash solution the vehicles was allowed to air dry. After the automobile was substantially dry, it was rinsed with a sufficient quantity of water to remove the anionic surfactant and soil from the surface, leaving behind the cationic wax and silicone components as a coating on the surface of the vehicle. The exterior surface of the vehicle was then towel dried.

Both compositions provided dried vehicle surfaces that had even, high-gloss, water resistant finishes without the need for buffing, which is generally required with automotive waxing products.

Numerous variations and modifications of the embodiments described above can be effected without departing from the spirit and scope of the novel features of the invention. It is to be understood that no limitations with respect to the specific embodiments illustrated herein are intended or should be inferred. It is, of course, intended to cover by the appended claims all such modifications as fall within the scope of the claims.

We claim:

1. An automotive wash and wax composition which is an aqueous emulsion comprising:

a) about 5 to about 40 weight percent anionic surfactant;

b) about 1 to about 10 weight percent silicone oil;

c) about 0.1 to about 1 weight percent amino-functional silicone;

d) about 0.01 to about 1 weight percent of a wax; and e) about 0.2 to about 0.9 weight percent cationic emulsifier.

2. The automotive wash and wax composition of claim 1 wherein the anionic surfactant is selected from the group consisting of an alkylcarboxylate, a polyalkoxycarboxylate, an N-acylsarcosinate, a linear alkylbenzenesulfonate, an alpha-olefin sulfonate, a dialkylsulfosuccinate, an alcohol sulfate, an ethoxylated alcohol sulfate, and a combination thereof.

3. The automotive wash and wax composition of claim 1 wherein the silicone is a polydimethylsiloxane having a viscosity in the range of about 10 to about 60,000 centistokes.

4. The automotive wash and wax composition of claim 3 wherein the silicone oil is a polydimethylsiloxane having a viscosity in the range 25 of about 350 to about 1000 centistokes.

5. The automotive wash and wax composition of claim 1 further comprising about 10 to about 20 weight percent of a nonionic surfactant.

6. The automotive wash and wax composition of claim 1 wherein the amino functional silicone is a polymer comprising repeating units represented by the general formula:

$$[—Si(R_{(2-p)})(Q_p)O—]_q[—Si(CH_3)_2O—]_y$$

wherein Q represents the radicals:

$$R'_2N—R"—,\ R'_2N—R"—N(R')—R"—\ \text{and}\ R'_2N—R"—O—R"—$$

R is $C_1$–$C_{18}$ alkyl or $C_6$–$C_{10}$ aryl; R' represents hydrogen or monovalent hydrocarbon radicals having 1 to about 18 carbon atoms; R" is a substituted or unsubstituted divalent $C_1$–$C_{18}$ hydrocarbon radical, a substituted or unsubstituted divalent oxyalkylene group in which the oxygen provides an ether linkage, or an unsaturated divalent $C_4$–$C_{18}$ hydrocarbon radical; p is number having a value in the range of about 1 to about 2; q is a number having value in the range of about 1 to about 2000; and y is a number having value in the range of about 0 to about 2000; with the proviso that the sum of q and y is at least about 15.

7. The automotive wash and wax composition of claim 1 wherein the amino-functional silicone is a copolymer having aminoethylaminopropylsiloxane and dimethylsiloxane repeating units.

8. The automotive wash and wax composition of claim 1 wherein the cationic emulsifier is selected from the group consisting of an amine, an aliphatic or rosin amine ethoxylate, an amidoamine, a quaternary ammonium salt and a combination thereof.

9. The automotive wash and wax composition of claim 1 wherein the wax is selected from the group consisting of a vegetable wax, a mineral wax; an animal wax, a synthetic wax, and a combination thereof.

10. An automotive wash and wax composition which is an aqueous emulsion comprising:

a) about 8 to about 30 weight percent anionic surfactant;

b) about 1 to about 6 weight percent silicone oil;

c) about 0.5 to about 0.8 weight percent amino-functional silicone;

d) about 0.05 to about 0.8 weight percent of a wax; and e) about 0.3 to about 0.7 weight percent cationic emulsifier.

11. The automotive wash and wax composition of claim 10 wherein the silicone oil and the amino-functional silicone are present in the aqueous silicone-based car wax emulsion in a weight ratio in the range of about 1:1 to about 5:1, silicone oil-to-amino-functional silicone.

12. The automotive wash and wax composition of claim 11 wherein the weight ratio of silicone oil-to-amino-functional silicone is in the range of about 2:1 to about 3:1.

13. The automotive wash and wax composition of claim 10 wherein the cationic emulsifier is present in the emulsion in a weight ratio of total silicone-to-cationic emulsifier of about 2:1 to about 5:1, wherein "total silicone" represents the sum of silicone oil content and amino-functional silicone content of the composition.

14. The automotive wash and wax composition of claim 13 wherein the weight ratio of total silicone-to-cationic emulsifier is in the range of about 3:1 to about 4:1.

15. The automotive wash and wax composition of claim 10 wherein the anionic surfactant is present in the emulsion in a ratio of anionic surfactant-to-cationic emulsifier of about 5:1 to about 150:1.

16. The automotive wash and wax composition of claim 15 wherein the weight ratio of anionic surfactant-to-cationic emulsifier is in the range of about 10:1 to about 60:1.

17. The automotive wash and wax composition of claim 10 wherein the silicone oil and wax are present in the emulsion in a weight ratio of silicone oil-to-wax in the range of about 5:1 to about 50:1.

18. The automotive wash and wax composition of claim 17 wherein the weight ratio of silicone oil-to-wax is in the range of about 15:1 to about 20:1.

19. The automotive wash and wax composition of claim 10 wherein anionic surfactant is selected from the group consisting of an alkylcarboxylate, a polyalkoxycarboxylate, an N-acylsarcosinate, a linear alkylbenzenesulfonate, an alpha-olefin sulfonate, a dialkylsulfosuccinate, an alcohol sulfate, an ethoxylated alcohol sulfate, and a combination thereof.

20. The automotive wash and wax composition of claim 10 wherein the silicone is a polydimethylsiloxane having a viscosity in the range of about 20 to about 5000 centistokes.

21. The automotive wash and wax composition of claim 20 wherein the silicone oil is a polydimethylsiloxane having a viscosity in the range of about 350 to about 1000 centistokes.

22. The automotive wash and wax composition of claim 10 wherein the silicone oil is a mixture of two or more different dimethysiloxanes having viscosities of about 350 centistokes and about 1000 centistokes respectively.

23. The automotive wash and wax composition of claim 10 wherein the amino-functional silicone is a polymer comprising repeating units represented by the general formula:

$$[—Si(R_{(2-p)})(Q_p)O—]_q[—Si(CH_3)_2O—]_y$$

wherein Q represents the radicals:

$$R'_2N—R"—,\ R'_2N—R"—N(R')—R"—\ \text{and}\ R'_2N—R"—O—R"—$$

R is $C_1$–$C_{18}$ alkyl or $C_6$–$C_{10}$ aryl; R' represents hydrogen or monovalent hydrocarbon radicals having 1 to about 18 carbon atoms; R" is a substituted or unsubstituted divalent $C_1$–$C_{18}$ hydrocarbon radical, a substituted or unsubstituted divalent oxyalkylene group in which the oxygen provides an ether linkage, or an unsaturated divalent $C_4$–$C_{18}$ hydrocarbon radical; p is number having a value in the range of about 1 to about 2; q is a number having value in the range of about 1 to about 2000; and y is a number having value in the range of about 0 to about 2000; with the proviso that the sum of q and y is at least about 15.

24. The automotive wash and wax composition of claim 23 wherein the amino-functional silicone is a copolymer having aminoethylaminopropylsiloxane and dimethylsiloxane repeating units.

25. The automotive wash and wax composition of claim 10 wherein the cationic emulsifier is selected from the group consisting of an amine, an aliphatic or rosin amine ethoxylate, an amidoamine, a quaternary ammonium salt and a combination thereof.

26. The automotive wash and wax composition of claim 10 wherein the wax is selected from the group consisting of a vegetable wax, a mineral wax, an animal wax, a synthetic wax and a combination thereof.

27. The automotive wash and wax composition of claim 10 wherein the wax is selected from the group consisting of a carnauba, candelilla, ouricury, montan, paraffin, microcrystalline wax, beeswax, an amide wax, a silicone wax and a combination thereof.

28. The automotive wash and wax composition of claim 10 which further comprises up to about 25 weight percent of a nonionic surfactant.

29. The automotive wash and wax composition of claim 28 wherein the nonionic surfactant is selected from the group consisting of an alcohol alkoxylate, a polyol ester of a fatty acid, a polyoxyethylene ester of a fatty acid, a fatty acid amide, a polyoxyethylene fatty acid amide, a polyalkylene oxide block copolymer, an ethoxylated alkyl mercaptan, an ethoxylated anhydrosorbitol ester, an alkyl polyglycoside, and a combination thereof.

30. The method of simultaneously washing and waxing an vehicle exterior surface which comprises the sequential steps of:

(a) wetting the exterior surface of a vehicle with water;

(b) applying to the exterior surface of the vehicle an automotive wash and wax composition comprising about 5 to about 40 weight percent anionic surfactant; about 1 to about 10 weight percent silicone oil; about 0.1 to about 0.1 weight percent amino-functional silicone; about 0.01 to about 1 weight percent of a wax; and about 0.2 to about 0.9 weight percent cationic emulsifier, in an amount sufficient to substantially cover the surface with the composition;

(c) drying the surface to form a translucent film thereon; and (d) rinsing the dried surface with a sufficient quantity of water to remove the translucent film;

such that a high-gloss, water resistant protective film remains on the vehicle exterior surface.

* * * * *